US006167970B1

(12) United States Patent
Stout et al.

(10) Patent No.: US 6,167,970 B1
(45) Date of Patent: Jan. 2, 2001

(54) ISOLATION TOOL RELEASE MECHANISM

(75) Inventors: Gregg W. Stout, Montgomery, TX (US); James T. Matte, Broussad, LA (US)

(73) Assignee: B J Services Company, Houston, TX (US)

( * ) Notice: Under 35 U.S.C. 154(b), the term of this patent shall be extended for 0 days.

(21) Appl. No.: 09/070,712

(22) Filed: Apr. 30, 1998

(51) Int. Cl.[7] ..... E21B 23/04; E21B 23/06

(52) U.S. Cl. ..... 166/377; 166/151; 166/181; 166/182; 166/324; 166/387

(58) Field of Search ..... 166/131, 149, 166/151, 377, 387, 123, 125, 181, 182, 324

(56) References Cited

U.S. PATENT DOCUMENTS 4,432,418 * 2/1984 Maryland ..... 166/133
4,688,634 * 8/1987 Lustig et al. ..... 166/120
5,727,632 * 3/1998 Richards ..... 166/387

OTHER PUBLICATIONS

"GPS–1 Gavel Pack System", BJ Services Company, Oct. 1995.

* cited by examiner

*Primary Examiner*—George Suchfield
(74) *Attorney, Agent, or Firm*—Howrey Simon Arnold & White, LLP

(57) ABSTRACT

A release mechanism for use with setting wellbore isolation tools, such as packers or bridge plugs. The release mechanism typically includes a release piston which selectively isolates equalization ports extending from the interior to the exterior of a setting tool body. The release piston may be activated to allow equalization of pressure across the sealing elements of a set isolation tool, typically by applying pressure to the annular space above the isolation tool. The release mechanism may be used to allow a tool body (such as a setting or retrieving tool) to be removed from a set isolation tool under conditions in which high pressure differential exists across the isolation tool.

28 Claims, 6 Drawing Sheets

ISOLATION TOOL RELEASE MECHANISM

BACKGROUND OF THE INVENTION

1. Field of the Invention

This invention relates generally to methods and apparatus for well completions and, more particularly, to methods and apparatus for setting and/or releasing from isolation tools within a well. Specifically, this invention relates to methods and apparatus for equalizing pressure differentials existing across the seals of a well isolation tool, such as a packer or bridge plug, during tool setting operations.

2. Description of Related Art

In well completions, it is often desirable to isolate one or more sections of a well from another. For example, one completion zone may be isolated from another so that only one completion zone is open for production or injection at a time. Such isolation may be accomplished by the placement of one or more isolation tools, such as packers and/or bridge plugs, in the wellbore on either or both sides of one or more completion zones. Isolation tools are typically annular in shape and configuration. The sequence of production from, or injection into, isolated completion zones formed by such tools and related well equipment is typically dictated by well and reservoir conditions. Such conditions may include different fluid loss characteristics from zone to zone, downhole well pressures which differ from zone to zone, and differing mineralogical conditions from zone to zone. In other cases, legal or regulatory requirements may dictate that individual zones be completed for production or injection individually. In still other cases, completion, workover and/or remedial operation concerns may dictate that individual zones be isolated and treated separately.

During well operations, an isolation tool may be set in a wellbore at a point below which no open perforations exist. This has the effect of creating a "closed volume" between the isolation tool and the bottom of the well. For example, a wireline or pipe-conveyed bridge plug may be set to form a plugback depth in order to eliminate unnecessary open wellbore at the bottom of the hole. In other cases, it may be desirable to position a wireline or pipe-conveyed packer prior to perforation and completion of wellbore intervals below the setting depth of the tool. Such completions are often made in relatively high or low pressure formations using pipe-conveyed perforating guns by setting a packer above the zone of interest with pipe conveyed perforating guns extending across the formation of interest. Once the packer is set, the zone of interest below the packer may be perforated with tubing or drill pipe in the hole so that the well casing above the packer is not exposed to the pressure of the formation. In other cases, a packer may be set above the zone of interest and through-pipe perforating guns may then be run out the end of the packer to perforate the formation. In still other cases, a sump packer may be first set between two zones of interest. A second packer and completion assembly may then be run and set above the upper zone of interest. In such cases, the completion assembly may include a seal assembly for location in the lower packer. This completion configuration allows the upper zone to be completed for production, treatment or injection first, while still allowing later completion in the lower zone through the sump packer. In still other cases, one or more zones of interest may be simultaneously completed in a similar manner and selectively produced using selective completion devices including, but not limited to, sliding sleeves and/or internal tubing plugs. The foregoing are just a few of the multitude of possible multiple and/or selective completion schemes that may be implemented using methods and apparatus known to those of skill in the art. In any of the aforementioned cases, it is typically necessary to retrieve a setting tool from a packer prior to adding perforations below the packer.

During gravel pack procedures, a region between two packers or between a bridge plug and packer may be gravel packed and isolated. In this method, a first isolation tool, such as a sump packer, may be set at a first location within a wellbore below the zone of interest and typically at a point below which no perforations exist. A gravel pack screen assembly may then be run into the wellbore on a second packer which may be positioned and set within the wellbore at a second location above the zone of interest. The zone of interest is typically perforated at some time prior to running the second packer. The zone may then be gravel packed using procedures known in the art. Using such a completion configuration, the gravel packed completion interval may be first produced while allowing for the possibility of future production of another zone located beneath the sump packer by, for example, later perforating a region below the sump packer with a through-pipe perforating gun. Another possible completion method may comprise selectively producing the region located between first and second packers and a region located below the first packer using isolation selective producing apparatus such as sliding sleeves, tubing plugs, etc. In still other cases, an upper completion interval may be gravel packed and isolated with, for example, a sliding sleeve and the lower completion interval then perforated through pipe and selectively produced as described above. In such completions, it is typically necessary to retrieve a setting tool from the first isolation tool under conditions in which a closed volume exists below the isolation tool.

During these and other types of wellbore operations, when a isolation tool such as a packer or bridge plug is set at a point in a wellbore having no perforations open below the setting point, a setting tool when pulled from the isolation tool may cause a vacuum or reduced pressure condition to exist below the isolation tool relative to the pressure existing above the isolation tool. Such a pressure differential typically acts on sealing elements or apparatus of the setting tool so that an unacceptably large amount of force may be required to pull the setting tool from is the isolation tool. When the force required to pull the setting tool from the isolation tool exceeds the maximum allowable pulling force, for example of tubing used to set the isolation tool, tubing failure may occur prior to the point where the setting tool becomes unseated from the isolation tool. In such cases, the setting tool may be referred to as being "differentially stuck" in the isolation tool. When such a condition exists, it may be necessary to perforate the tubing in order to equalize the pressure, or even to sever the tubing so that it may be retrieved from the hole. Perforating or severing the tubing is undesirable because it may damage downhole completion assemblies leaving the isolation tool and/or setting tool in unusable condition, and even potentially "junking" the well. In some cases, a sufficient pressure differential may be created during attempted pulling of a setting tool such that a collapse force is generated across the isolation tool components resulting in tool failure.

Undesirably high pressure differentials may also be created when pulling a setting tool out of an isolation tool even where open perforations exist below the isolation tool. Such a problem may exist, for example, where the perforations are of limited entry into the formation, where a formation is very tight (or has very low permeability), and/or where the permeability of a perforated formation is damaged.

SUMMARY OF THE INVENTION

The disclosed method and apparatus may be used for setting or retrieving an isolation tool in a well, particularly in situations in which a pressure differential exists across the seals of the tool. Such situations include those where a substantially closed volume exists below the isolation tool, for example, where no perforations, mechanical isolation, ineffective perforations or perforations into low permeability or damaged formations exist below the isolation tool. Advantageously, the disclosed method and apparatus provide for, among other things, an annulus actuated straight pull tool release while allowing pressure equalization between regions above and below an isolation tool.

This invention in one respect concerns a well tool employing a release mechanism for setting and/or releasing from a packer or other well isolation tool in a well, and for equalizing pressures between isolated portions of the well. The release mechanism helps to enable the tool to be removed from the well after the isolation tool has been set. In one typical embodiment a well tool comprises generally a cylindrical tool body defining a central axial passageway and a port in the wall of the body effecting communication between the central passageway and a portion of the well above the isolation tool when set. In this embodiment an annular sleeve-like piston fits between the tool body and the isolation tool and is movable between two positions along the tool body in response to a differential pressure between the portions of the well above and below the isolation tool. In a first such position the piston seals the port, and in a second such position the piston exposes the port to the pressure in the portion of the well above the isolation tool.

In one exemplary embodiment, a well tool further comprises an annular valve seat which fits within the central passageway of the tool body and is releasably moveable along the passageway. The valve seat is configured to act as a seat for a ball traveling downward in the central passageway. With the ball thus seated, the annular valve seat is responsive to a pressure from above the seated ball to drive the ball and the seat from a first position within the tool body to a lower position.

The disclosed release mechanism has particular application in setting hydraulically activated packers in a well. For example, a well tool comprising a hydraulically activated setting tool with the disclosed release tool mechanism may be employed for relieving pressure differentials above and below the packer after it has been set. Relief of the pressure differentials enables the setting tool to be released from the packer and retrieved from the well. Hydraulic actuation of the packer may be effected in different ways. In this embodiment, the setting tool typically has a central passage extending along its length and a valve seat configured to seat a ball lowered into the passageway. Hydraulic pressure generated within the setting tool above the ball is then employed to actuate the packer. Once set, hydraulic pressure within the annular space above the packer and between the setting tool and the wall of the well is then employed to actuate a sleeve valve or piston fitted between the setting tool and the packer to open a port in the wall of the setting tool and thereby establish pressure communication between the annular portion of the well above the packer and the well below the packer. To further facilitate removal of the setting tool from a well, the valve seat within the setting tool may itself be hydraulically actuated to move to a lower position in the tool body to expose a port which bypasses the ball valve. Fluid in a tubing string above the setting tool may thereby drain through the port as the string and the setting tool are removed from the well.

Accordingly, in one further respect, this invention is a release tool for use with an isolation tool having an inner diameter. In one embodiment the release tool may include a tool body having first and second ends, a longitudinal axis and an inner diameter and an outer diameter. In this embodiment, the tool body outer diameter is complementary to the inner diameter of the isolation tool such that the tool body may be received within the isolation tool inner diameter to form a first annular space between the isolation tool inner diameter and the tool body outer diameter. At least one equalizing port is typically defined in the tool body between the first and second ends of the tool body and extends through the tool body from the tool body outer diameter to the tool body inner diameter. This embodiment of the release mechanisms also typically includes a release piston having an inner diameter complimentary to the tool body outer diameter that is concentrically and slidably disposed about the tool body outer diameter. In this embodiment, the release piston is typically slidable along the longitudinal axis of the tool body between first and second positions, and has an outer diameter complimentary to the isolation tool inner diameter such that the tool body may be received within the isolation tool inner diameter. This embodiment of release tool also typically includes a release piston first seal and a release piston second seal, the first and second release piston seals being disposed in sealing relationship between the release piston inner diameter and the tool body outer diameter. In this regard, the first release piston seal is typically disposed toward the first end of the tool body and the second release piston seal is typically disposed toward the second end of the tool body, with the first and second release piston seals being spaced apart to isolate the equalizing port from fluid communication with the first annular space when the release piston is in the first position and to allow fluid communication between the equalizing port and the first annular space when the release piston is in the second position.

In another embodiment of the above-described tool, a third seal may be provided between the isolation tool inner diameter and the tool body outer diameter and disposed between the release piston and the tool body second end, so that the third seal forms a seal between the isolation tool inner diameter and the tool body outer diameter to isolate the first annular space adjacent the first end of the tool body from the isolation tool inner diameter adjacent the second end of the tool body, and in such a way that the release piston is shiftable between the first position and the second position in response to fluid pressure applied to the first annular space adjacent the first end of the tool body. The first and second release piston seals and the third seal typically are configured to isolate the first annular space adjacent the first end of the tool body from the isolation tool inner diameter adjacent the second end of the tool body when the release piston is in the first position, but are also configured to allow fluid or pressure communication through the equalizing port between the first annular space adjacent the first end of the tool body and the isolation tool inner diameter adjacent the second end of the tool body when the release piston is in the second position. The tool body may further include a setting seat piston having an outer diameter concentrically and slidably received within the inner diameter of the tool body to form a seal with the inner diameter of the tool body, and may be configured with an aperture and setting seat to receive a setting ball in sealing arrangement, the setting seat piston being operable between a first position adjacent the equalizing port and a second position between the equalizing point and the second end of the tool body. In one embodiment, at least one unloading port may be defined to extend through the tool body from the tool body outer diameter to the tool body inner diameter at a point located between the equalizing port and the second end of the tool body, and the setting seat piston may be operable between a first position adjacent the equalizing port and a second position adjacent or below the unloading port. The setting seat piston typically has a cylindrical body having an inner diameter, and further typically includes a setting seat port defined to extend from the setting seat outer diameter to the setting seat inner diameter. In this regard, the setting seat port is typically disposed adjacent the equalization port when the setting seat piston is in the first position to enable fluid communication between the equalizing port and the tool body inner diameter when the setting seat piston is in the first position.

In still another embodiment, the above-described release tool may be employed to hydraulically set an isolation tool in response to a first fluid pressure applied to the inner diameter of the tool body from the first end of the tool body when a setting ball is sealably received in the setting seat of the setting seat piston. In another embodiment, the setting seat piston may be shiftable between the first position and the second position in response to a second fluid pressure applied to the inner diameter of the tool body from the first end of the tool body when a setting ball is received in the setting seat of the setting seat piston. In this regard, the second fluid pressure is typically greater than the first fluid pressure. The release tool may further including a collet having collet fingers and that is concentrically disposed about the outer diameter of the tool body between the equalizing port and the first end of the tool body such that the release piston is disposed between the collet fingers and the tool body when the release piston is in the first position, and so that the release piston is disposed between the collet and the second end of the tool body when the release piston is in the second position. The release piston may also further include a release piston locking key movably disposed within the release piston, the release piston locking key being movable between a first position within the release piston and a second position extended outward from the release piston toward the isolation tool inner diameter; wherein the release piston locking key is contained in the first position by contact with the collet when the release piston is in the first position; wherein the tool further includes a release piston spring disposed between the tool body outer diameter and the release piston locking key such that the release piston spring is contacted by and compressed by the release piston locking key when the release piston is positioned in the first position between the collet and the tool body and such that the release piston locking spring contacts and forces the release piston locking key outward into the second position when the release piston is in the second position; and wherein the release piston locking key is positioned to contact the collet when in the second position to prevent movement of the release piston into the first position.

This invention in still another respect, is a method of removing a release tool as defined above from an isolation tool having an inner diameter. The method typically includes the steps of moving the release piston from the first position to the second position to allow fluid communication between the equalizing port and the first annular space, and removing the tool body from the isolation tool. In one embodiment, the tool body first end is adapted for connection to a retrieving medium, and the step of removing the release tool includes pulling the tool body from the inner diameter of the isolation tool with the retrieving medium. The tool body may further include a third seal between the isolation tool inner diameter and the tool body outer diameter that is disposed between the release piston and the tool body second end. In this capacity, the third seal forms a seal between the isolation tool inner diameter and the setting tool body outer diameter so as to isolate the first annular space adjacent the first end of the tool body from the isolation tool inner diameter adjacent the second end of the tool body, and such that the release piston is shiftable between the first position and the second position in response to fluid pressure applied to the first annular space. In this case, the step of sliding further typically includes applying sufficient fluid pressure to the first annular space to shift the release piston from the first to the second position.

This invention in still another respect is a release mechanism for use with an isolation tool positioned within a wellbore and adapted to isolate a portion of the wellbore above the isolation tool from a portion of the wellbore below the isolation tool. The release mechanism typically includes a tool body adapted to be received within the isolation tool, a first port in the wall of the tool body enabling fluid communication between the portion of the wellbore above the isolation tool and the portion of the wellbore below the isolation tool, and a slide valve slideable to move between a first seal position sealing the port and a second open position exposing the first port. In one embodiment, the slide valve typically includes an annular slide valve fitted between the tool body and the isolation tool. In another embodiment, the tool body is typically adapted at its upper end to be connected to a retrieving medium, an annular portion of the wellbore is defined between the retrieving medium and the wellbore, and the first port enables fluid communication between the annular portion of the wellbore above the isolation tool and the portion of the wellbore below the isolation tool. The slide valve may be fitted around the tool body and movable relative to the tool body in response to a pressure differential between the annular portion of the wellbore and the portion of the wellbore below the isolation tool to move from the first sealing position to the second open position exposing the first port to fluid communication with the annular portion of the wellbore. The slide valve may also be slideable from the first seal position to the second open position in response to a preselected differential pressure between the annular portion of the wellbore above the isolation tool and the portion of the wellbore below the isolation tool. The tool body may include a setting mechanism operable to set the isolation tool within the wellbore. In one embodiment, the tool body has upper and lower ends and is typically adapted at its upper end to be lowered within a wellbore on a conduit string and is further adapted to releasably engage and set the isolation tool against the wall of the wellbore. In this embodiment, the tool body also typically defines a central longitudinal bore in fluid communication with the conduit string and the first port extending through the wall of the tool body to enable fluid communication between the annular space between the conduit string and the wall of the wellbore and the portion of the wellbore below the set isolation tool. A valve seat may be positioned in the central longitudinal bore in a first position and adapted to seat a valve operable to block fluid flow down through the central longitudinal bore. A second port may be defined to extend laterally from the central longitudinal bore through the wall of the tool body and positioned between the first position and the lower end of the tool body. The valve seat may be movable between the first position and a second position exposing the second port to the central longitudinal bore. In this regard, the valve seat is typically movable when seating a valve toward the second position in response to fluid pressure within the central longitudinal bore above the valve seat. Typically the valve seat is configured to receive a generally spherical valve, such as a ball, semi-spherical-shape, or other similar device.

In still another respect, this invention is a method of removing a release mechanism as defined in the preceding paragraph from an isolation tool positioned in a wellbore in which the isolation tool has been placed to isolate a portion of the wellbore above the isolation tool from a portion of the wellbore below the isolation tool. This method typically includes moving the slide valve from its first sealing position to its second open position to thereby reduce any pressure differential between the two portions of the well, and thereafter removing the release mechanism from the isolation tool. In one embodiment of this method, the tool body may be adapted at its upper end to be connected to a retrieval medium so that an annular portion of the wellbore is defined between the retrieval medium and the wellbore, and so that the first port enables fluid communication between the annular portion of the wellbore above the isolation tool and the portion of the wellbore below the isolation tool. In this embodiment, the slide valve is typically fitted around the tool body and movable relative to the tool body in response to a pressure differential between the annular portion of the wellbore and the portion of the wellbore below the isolation tool to move from the first sealing position to the second open position exposing the first port to fluid communication with the annular portion of the wellbore. This embodiment includes the steps of applying sufficient pressure within the annular space to move the slide valve from the upper position to the lower position and reduce any the pressure differential, and then removing the release mechanism from the isolation tool.

DESCRIPTION OF ILLUSTRATIVE EMBODIMENTS

Figure 1:
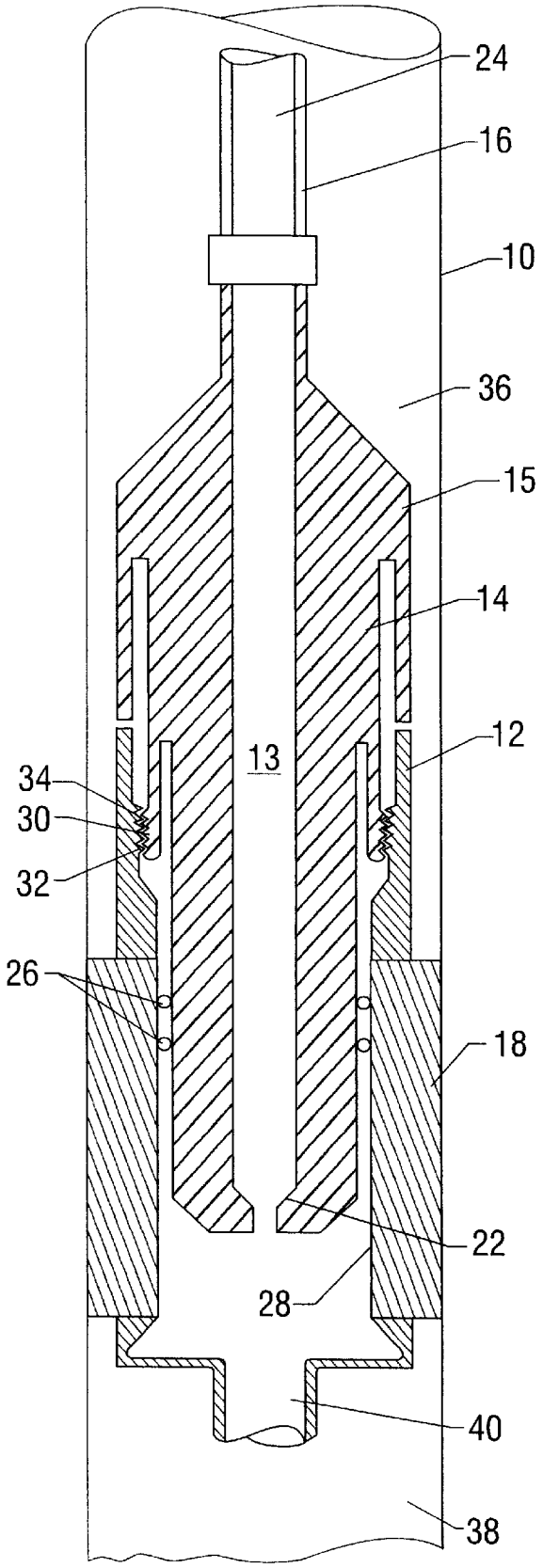
FIG. 1 (PRIOR ART)
FIG. 1 is a simplified cross-sectional view of a conventional setting tool and packer suspended in a wellbore on tubing.

The disclosed method and apparatus are useful for, among other things, in setting and/or retrieving isolation tools such as packers or bridge plugs in wellbores in which a relatively high pressure differential exists above and below the isolation tool. In particular, the disclosed methods and apparatus include a release mechanism useful for setting and/or retrieving isolation tools in wellbores in which such conditions exist. Advantageously, embodiments of the disclosed release mechanism may include one or more pressure equalization ports or openings through which pressure may be selectively equalized above and below an isolation tool prior to removing, for example, a setting tool from the isolation tool. The disclosed release mechanism is typically configured for use in a setting and/or retrieving tool configuration designed to set or retrieve an isolation tool on a conduit, such as tubing or drill pipe, either mechanically or hydraulically. However, embodiments of the disclosed release mechanism may also be configured for setting, mating with, manipulating and/or retrieving isolation tools, as well as performing same on any other suitable retrieving medium. In this regard, "retrieving medium" means any conduit or non-conduit material suitable for insertion or lowering into and removal from a wellbore. Typical examples of conduit strings include, but are not limited to, tubing (including production tubing), drill pipe, work string, coil tubing, threaded tubing, snubbing unit tubing, etc. Typical examples of non-conduit materials include, but not limited to, wire line, slickline, swabline, etc. Furthermore, any tool employing the disclosed release mechanism may also be referred to as a "release tool," regardless of what other function the tool performs in relation to an isolation tool.

The disclosed methods and apparatus may be employed as part of any wellbore operation in which one or more isolation tools are employed in a wellbore, but most advantageously during wellbore operations in which relatively high pressure differentials exist across an isolation tool during the setting and/or release from the tool. As used herein, "wellbore" means any cased, partially cased, and/or uncased (or open hole) well, and "wellbore operations" includes any operations in which isolation tools, such as packers and/or bridge plugs (including inflatable and/or open hole isolation tool applications), may be employed within a wellbore. Typical examples include cementing, stimulation, sand control, workover and remedial operations. "Isolation tool" means any tool used to isolate one or more sections of a wellbore from pressure and/or fluid communication with other sections of a wellbore, including, but not limited to, packers (such as gravel pack, sump packers, etc.), bridge plugs, zonal isolation assemblies, etc. The wellbore may be a cased, partially cased, or uncased.

Specific examples of typical applications for the disclosed method and apparatus include, but are not limited to, use with hydraulic cross-over or setting tools for GPS-1 or GPS-2 gravel pack packers (available from BJ Services), or with hydraulic setting tools for use with WESTDRILL (WESDRILL) SUMP PACKER isolation tools. As used herein "setting tool" includes any tool for use in setting and/or retrieving an isolation tool, and "setting tool body" refers to the body of any such setting and/or retrieving tool. Although the embodiments described herein typically relate to pipe conveyed isolation and setting tools, (e.g., tubing, work strings, drill pipe, etc.), it will be understood with benefit of this disclosure that benefits of the disclosed method and apparatus may also be realized with isolation tools and/or setting tools designed to be run in any other manner including, but not limited to, on coil tubing, wire line, or threaded pipe.

FIG. 1 is a simplified schematic of a wellbore 10 in which a packer 12 has been positioned with a conventional setting tool 14 on tubing 16 which may be any wellbore tubular suitable for setting and/or retrieving isolation tools including, but not limited to, workstring, production tubing, drill pipe, coiled tubing, etc. As may be seen in FIG. 1, packer 12 has been set and packer seals or elements 18 contact the interior casing walls of wellbore 10. Packer 12 may be set, for example, by application of tubing pressure to the setting tool 14 As shown, setting tool 14 has an interior bore 13 and an outer diameter with seal elements 26 which contact and form a hydraulic seal with interior walls of seal bore 28 of packer 12. Setting tool 14 also includes collet 30 having collet fingers 32 for removable mechanical engagement in complementary threaded area 34 of packer 12 for mechanically connecting setting tool 14 to packer 12. In this regard, setting tool 14 may be received in and releasably connected to packer 12 via engagement of collet fingers 32 with threaded region 34 for purposes of running and setting packer 12 in wellbore 10.

In the conventional setting tool system of FIG. 1, packer 12 may be set in wellbore 10 by connecting setting tool 14 to tubing string 16 and running the entire assembly into wellbore 10 with packer elements 18 in non-extended or in un-set position. Once packer 12 has been located at the correct depth in wellbore 10 a ball may be dropped to seat in ball seat 22 of setting tool 14 and pressure applied to the interior 24 of tubing string 16 to cause internal pressure in setting tool 14. This internal pressure actuates a setting piston 15 which engages with and sets packer 12 by, among other things, actuating and extending elements 18 to form a hydraulic seal with the interior walls of wellbore 10 and to thus set packer 12. With packer 12 in this set condition, upper annular area 36 is hydraulically isolated from pressure or fluid communication with lower wellbore area 38 by virtue of the hydraulic seal formed between packer element 18 and wellbore 10, and the hydraulic seal formed between setting tool seals 26 and packer seal bore 28. In this condition, any pressure differential existing between annular space 36 (above packer 12) and wellbore area 38 (below packer 12) acts upon seals 26 via communication past collet fingers 32 and through the open end 40 of packer 12. For example, should the pressure in annular space 36 exceed the pressure in wellbore space 38, a resultant and proportional downward force will be placed upon seals 26 which tends to resist upward withdrawal or removal of setting tool 14 from packer 12.

In those cases where a substantially closed volume exists below packer 12 (e.g., where no perforations exist below packer 12, or where ineffective perforations or perforations into damaged or reduced permeability formations exist below packer 12), attempted removal of setting tool 14 from packer 12 tends to cause an increased pressure differential across seals 26 and/or to create a vacuum in wellbore area 38 by virtue of the "swabbing" effect of the upward movement of seals 26 against the inner surface of packer seal bore area 28. As previously mentioned, when the force required to withdraw setting tool 14 upward from packer 12 exceeds the maximum acceptable pull on tubing string 16, differential sticking of setting tool 14 within packer 12 may occur. Such differential sticking may occur when the static pressure differential between annular space 36 and wellbore space 38, and/or the dynamic pressure differential between wellbore spaces 36 and 38 during attempted withdrawal of setting tool 14 from packer 12, exerts sufficient force on seal elements 26 to cause the force required to remove setting tool 14 from packer 12 to exceed the maximum allowable pulling force on tubing string 16.

Figure 2:
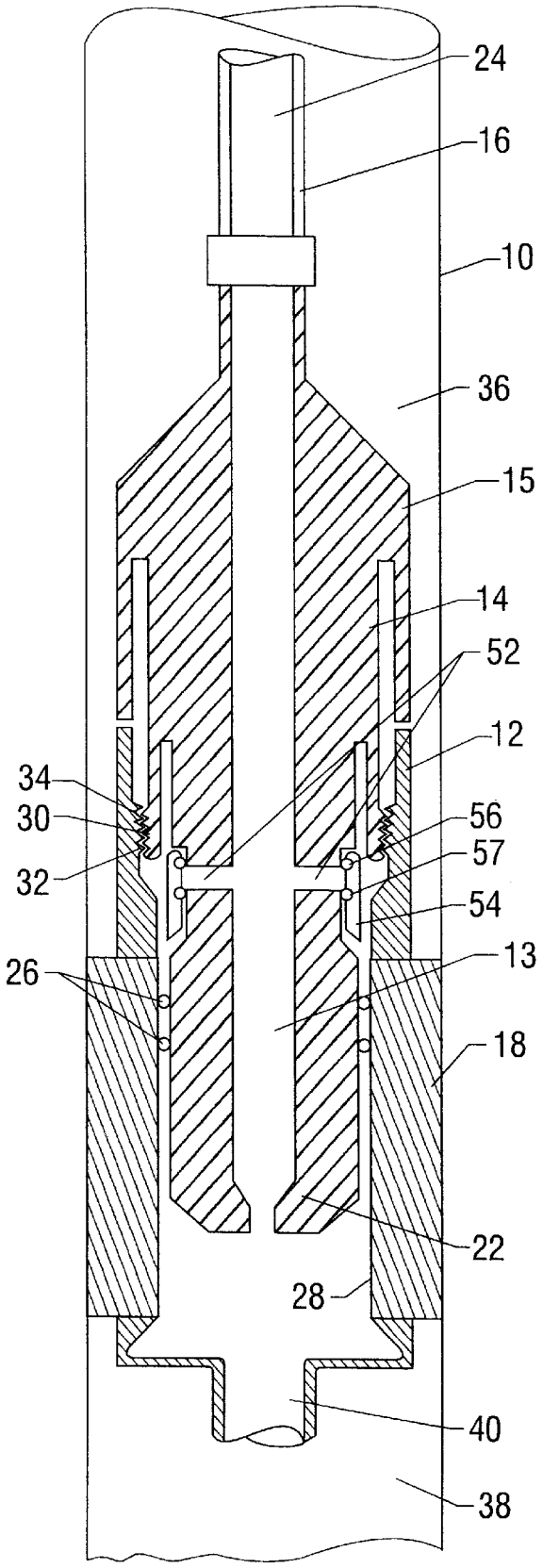
FIG. 2 is a simplified cross-sectional view of a packer and setting tool suspended with a wellbore on tubing, the setting tool including a release mechanism according to one embodiment of the disclosed method and apparatus.
Figure 3:
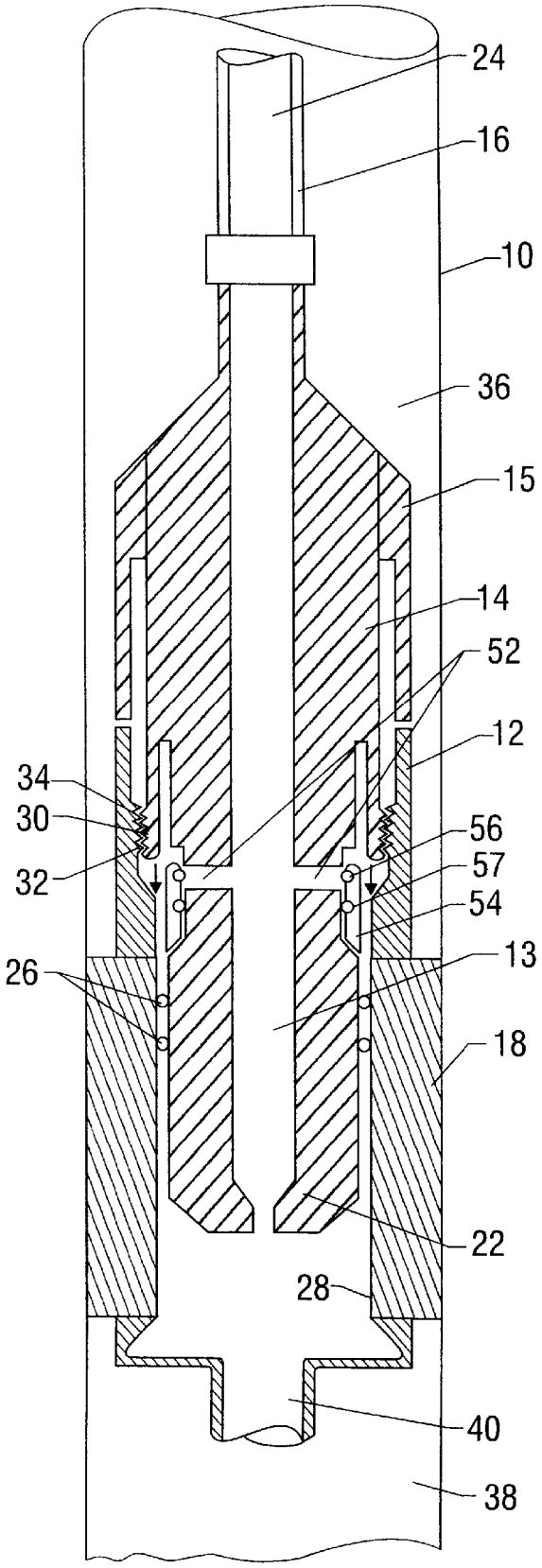
FIG. 3 is a simplified is a cross-sectional view of a packer and setting tool suspended within a wellbore on tubing, the setting tool including a release mechanism according to one embodiment of the disclosed method and apparatus.

FIGS. 2–6 illustrate just one possible exemplary embodiment of the disclosed release mechanism for use with an isolation tool (in this case a packer), with it being understood that a variety of other configurations are also possible. FIG. 2 is a simplified illustration of one example of a setting tool 14 incorporating one embodiment of the disclosed release mechanism. In this embodiment, equalization ports 52 are provided to extend from the exterior diameter of setting tool 14 to the interior diameter of setting tool 14 so as to provide communication between setting tool bore 13 and the exterior of setting tool 14, and therefore between annular space 36 and wellbore space 38. A concentric release piston, slide valve, sleeve valve or the like 54 having isolation seals 56 and 57 is provided to selectively close off equalization ports 52 and therefore hydraulically isolate the interior of setting tool 14 from the exterior of setting tool 14. In this embodiment, release piston 54 is slidably disposed about the outer diameter of setting tool 14 and configured to be operable between a first or closed isolation position (as shown in FIG. 2) and a second or open equalization position as shown in FIG. 3. When in first or isolation position, release piston 54 therefore serves to isolate annular space 36 from pressure and fluid communication with wellbore space 38.

In a typical setting operation, after packer 12 has been set and it is desired to remove setting tool 14 from the interior of packer 12, pressure may be applied to annular space 36 in order to shift release piston 54 downward as shown in FIG. 3. When release piston 54 is shifted downward into equalization position as shown in FIG. 3, seals 26 no longer straddle or isolate equalization ports 52. Thus, equalization of pressure occurs between annular space 36 and wellbore space 38 through equalization ports 52 and collet fingers 32. Once equalization occurs, collet fingers 32 of setting tool 14 may be unscrewed or setting tool 14 otherwise mechanically disconnected from packer 12. Setting tool 14 may then be removed from packer 12 by pulling upward on tubing string 16. Because equalization ports 52 allow pressure to equalize between annular space 36 and wellbore space 38, substantially no pressure differential exists across seals 26 and therefore the force (e.g., tubing pull) required to remove setting tool 14 from packer 16 is substantially unaffected by any additional force required to overcome pressure differential across seals 26.

Although FIGS. 2 and 3 illustrate one exemplary embodiment, it will be understood that other embodiments of the disclosed release mechanism comprising at least one equalization port and associated release piston may be employed in a variety of configurations and for use with a variety of tool types, for example, setting and retrieving tools. For example, although FIGS. 2 and 3 illustrate a setting tool 14 having a mechanical collet connection with packer 12, it will be understood with benefit of the present disclosure that the disclosed release mechanism may be employed with tools having any suitable type of other assembly for mechanical connection with a packer, bridge plug, or other isolation tool. For example, key and piston arrangements, shear pin arrangements, etc.

Furthermore, although a tubing conveyed hydraulically set packer has been described and illustrated herein, it will be understood with benefit of the present disclosure that embodiments of the disclosed release mechanism may be beneficially employed with any other type of configuration of packer or other isolation tool in which a pressure differential may exist across setting tool/isolation tool seals. In this regard, embodiments of the disclosed release mechanism may be employed with a wide variety of packer types including, but not limited to, retrievable gravel pack, production and sump packers, permanent production, isolation, and sump packers, and inflatable tools. In addition, it will be understood that embodiments of the disclosed release mechanism may be employed with a wide variety of other types of isolation tools including, but not limited to casing polished bore receptacles ("PBR's"), zonal isolation liners, casing patches, straddle packers, etc. Furthermore, it will be understood that the disclosed release mechanism may be employed with a number of tool types, including setting tools and/or retrieving tools that operate with any combination of wireline set, wireline retrieve, tubing set and/or tubing retrieve, and/or tubing retrieve action, as well as setting and/or retrieving tools designed to operate on coiled tubing, slick line, swab line, etc.

In the practice of the disclosed method and apparatus, any number and configuration of equalization ports may be employed. However, typically, a suitable number and size of equalization ports are provided to achieve an effective or total equalization cross sectional area of greater than about 0.196 $in^2$, and more typically greater than about 0.785 $in^2$. Each equalization port may be of any shape desired and may be oriented to pass through a setting tool body in a number of ways, as long as the port is configured to be selectively isolated by a release piston. In this regard, a release piston may be configured to slide or otherwise expose the equalization port in a setting tool in any suitable manner. Typically, a release piston is concentrically disposed about a setting tool and configured with seals, most typically O-ring seals, which are spaced so as to straddle the equalization port when the release piston is in closed or isolation position as shown in FIG. 2. However, with benefit of this disclosure those skilled in the art will understand that other configurations of seals and/or equalization ports are possible including, but not limited to, ball valves, KOBE plugs, flappers, etc.

A release piston is typically configured to be actionable, or to slide from closed (isolation position) to open (equalization position), in a predetermined applied pressure differential range across the release piston, typically by the incorporation of shear screws. However, with benefit of this disclosure those skilled in the art will understand that any other suitable method for holding an equalization piston in a first isolation position and for allowing a release piston to move to equalization position at a predetermined annular pressure may be employed including, but not limited to methods employing one or more collets, shear rings, etc. Furthermore, it will be understood that more than one release piston may be employed with a number of equalization ports. Other alternative embodiments include configurations in which a release piston is disposed to operate within the interior of a setting tool, and/or in which a release piston is configured to be mechanically actionable as well as hydraulically actionable.

Figure 4:
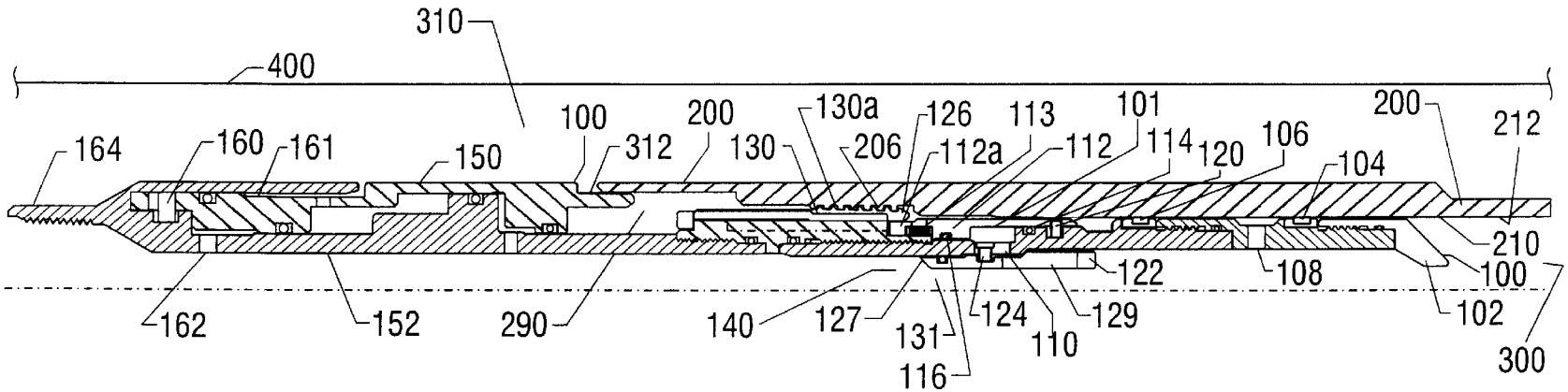
FIG. 4 is a cross-sectional view of a packer and setting tool, the setting tool including a release mechanism according to one embodiment of the disclosed method and apparatus.

Referring now to FIG. 4, one typical embodiment of a cross-over or setting tool 100 configured with a release mechanism 101 will now be described in greater detail. In the embodiment illustrated in FIG. 4, setting tool 100 is configured for use with a pipe conveyed hydraulic set packer 200, such as for running into a wellbore having a wellbore wall 400. Such setting tools may be constructed with benefit of this disclosure using any suitable materials known in the art, for example, 4140 heat treated alloy steel, chrome alloys, nickel alloys, etc. As shown in FIG. 4, setting tool 100 includes a nose 102, unloading port 108, setting seat piston or sleeve 122, collet 126, release piston 112, equalizing port 110, piston assembly 150, setting port 162, shear pin or other frangible or releasable device 160, setting piston 161, and threaded connection 164.

In FIG. 4, setting tool 100 is shown received within bore 210 of packer 200, in this case a is permanent sump packer. FIG. 4 shows setting tool 100 in "run-in" position with setting seat piston 122 and release piston 112 held in position by shear screws, pins or the like 124 and 120, respectively. As may be seen in FIG. 4, setting tool 100 has been received and located within the bore of packer 200. Setting tool seal elements 104 and 106 are shown received in sealing relationship with the interior of packer seal bore 212. Collet fingers 130 and collet teeth 130*a* of setting tool 100 are shown received in locking relationship with internal collet threads 206 of packer 200, so as to mechanically connect and suspend packer 200 from setting tool 100. In this configuration, packer 200 is configured for placement in a wellbore using tubing connected to threaded connection 164 of setting tool 100.

As shown in FIG. 4, setting tool 100 has a first end with nose 102 and a second end with threaded connection 164. Threaded connection 164 may be configured for connection to tubing, drill pipe, coil tubing or other means for conveying setting tool 100 and packer 200 into a wellbore. It will also be understood with benefit of this disclosure that other types of connections known to those of skill in the art may be employed in place of threaded connection 164. Setting tool 100 has a body configured with an outer diameter complementary to the inner diameter or bore of packer 200 so that setting tool 100 may be received within packer 200 forming an annular space 290 between the inner diameter or bore of packer 200 and the outer diameter of setting tool body 100. Setting tool 100 is typically configured with seals 104 and 106 which are configured to seal against seal bore 212 of packer 200 to prevent fluid movement past setting tool 100. Setting seat piston 122 is shown slidably received within interior of setting tool 100 and held in unset position by shear screw 124. Setting seat piston 122 is designed for receiving a ball 125 (as pictured in FIGS. 5 and 6) for setting packer 200 and, in this regard, is typically configured with an aperture 131 and ball seat 127.

Release piston 112 has an inner diameter complementary to the outer diameter of setting tool 100 and is concentrically and slidably disposed about the outer diameter of setting tool 100, so that it is slidable along the longitudinal axis of the body of setting tool 100. The outer diameter of release piston 112 is complementary to the inner diameter of packer 200, and a pivotal or otherwise movable release piston locking key 112*a* is provided (typically as a cut out section of release piston 112). A release piston spring 113 positioned beneath and in contact with release piston locking key 112*a* is provided or disposed between setting tool body 100 and upper end of release piston locking key 112*a*. In run-in position, spring 113 is in compressed position by virtue of containment of upper end of release piston locking key 112*a* in position underneath collet 126.

In run-in position as illustrated in FIG. 4, release piston 112 is disposed in a first isolation position adjacent equalizing port 110 in setting tool body 100, so that O-ring seals 116 and 114 are in turn positioned on either sides of equalizing port 110, and in sealing contact with sealing areas on outer diameter of setting tool 100 and inner diameter of release piston 112, respectively as shown. In this embodiment, such sealing areas typically have a surface with a fine RMS, for example, typically about 125 RMS or less. However, with benefit of this disclosure it will be understood that any suitable sealing area finish (RMS), or alternative sealing configuration known in the art may be employed. In this position, seals 116 and 114 form a pressure and fluid seal between the interior diameter of release piston 112 and the outer diameter of setting tool body 100, thus effectively isolating interior 140 of setting tool 100 from pressure and fluid communication with packer/setting tool annular space 290. Release piston 112 is shown held in this position by shear screw 120.

Figure 5:
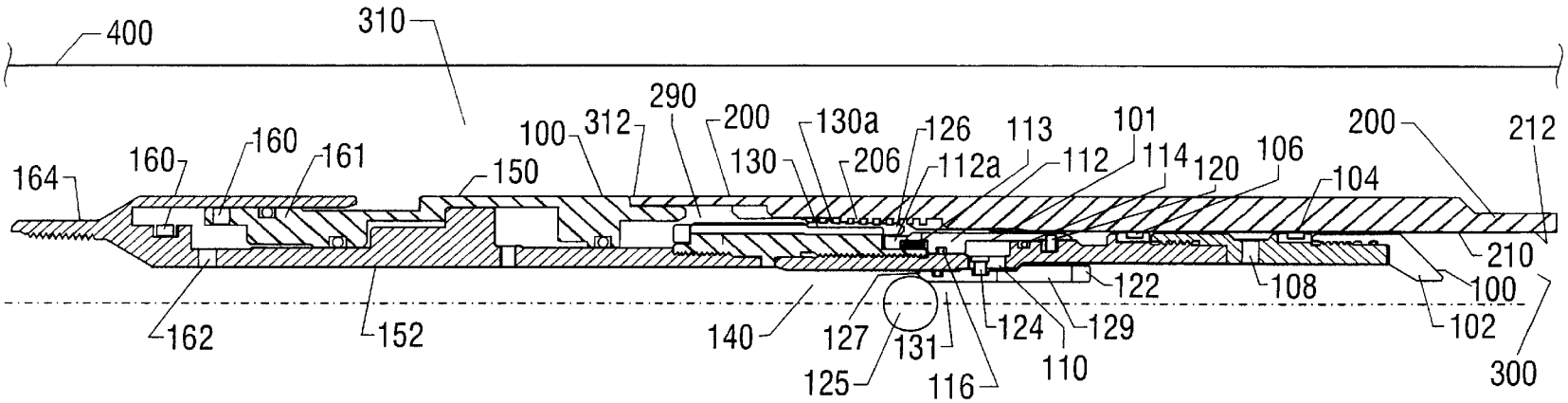
FIG. 5 is a cross-sectional view of a packer and setting tool, the setting tool including a release mechanism according to one embodiment of the disclosed method and apparatus.

FIG. 5 illustrates the embodiment of setting tool 100 of FIG. 4 with packer 200 shown in set position as would be the case within a wellbore having a wellbore wall 400. In FIG. 5, setting ball 125 has been dropped or otherwise introduced from the surface so as to seat and form a hydraulic seal with ball seat 127 of setting seat piston 122. Packer 200 has been set by applying pressure to setting tool interior 140 (typically via tubing pressure, for example about 2600 psi), thus shearing pin 160 and setting packer 200 by internal hydraulic pressure acting on setting piston 161. In this regard, setting piston 161 strokes downward and pushes against top of packer 200 to set the packer. In this embodiment, packer setting pressure is less than the pressure required to shear screw 124, which is typically brass or other suitable material or device for selective shearing or actuation.

Figure 6:
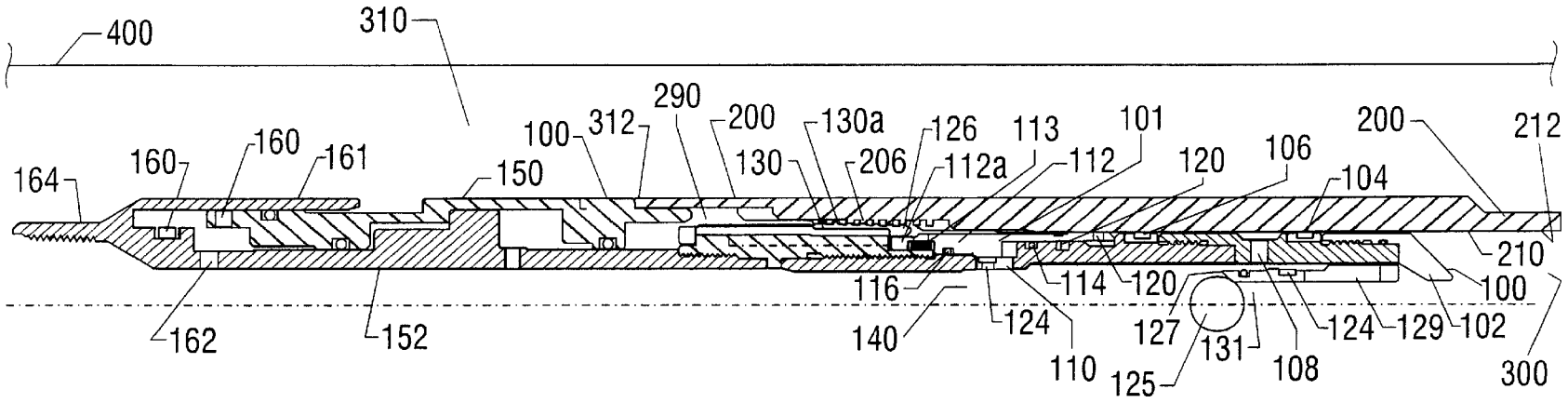
FIG. 6 is a cross-sectional view of a packer and setting tool, the setting tool including a release mechanism according to one embodiment of the disclosed method and apparatus.

FIG. 5 shows setting tool 100 after shear pin 160, has been sheared. Shearing of pin 160 and setting packer 200 has been described above. The effects of shearing pins 120 and 124 is now described below. FIG. 6 shows release piston 112 in shifted or equalization position. To shift release piston 112 to this position, pressure has been applied to annular space 290 (typically by pressuring up on the wellbore annulus between the tubing and well casing, for example about 1000 psi). Prior to shifting of release piston 112, pressure applied to annular space 290 is contained within space 290 by seals 106, 114 and 116, thereby creating a pressure differential across release piston 112 (or the differential area between seals 114 and 116), which acts to force release piston 112 downward against shear screw 120, which is typically brass. When sufficient force is developed to shear screw 120, release piston 112 is forced down out from under collet 126 and into equalization position as shown in FIG. 6. In this position, release piston spring 113 is allowed to act to move or force upper end of release piston locking key 112*a* outward or away from setting tool body 100, thus serving to lock release piston 112 in equalization position by virtue of mechanical interference between upper end of release piston locking key 112*a* with collet 126.

Shearing of pin 120 allows movement of release piston 112 downward and exposes equalizing port 110 to pressure and fluid communication with annular space 290 through collet fingers 130 as shown in FIG. 6, thus allowing pressure equalization between annular space 290 and setting tool bore interior space 140 through setting seat piston port 129 (prior to shearing pin 124 as described below). Setting tool bore 140 is in turn in pressure and/or fluid communication with wellbore space 300 existing below packer 200 by means of a flow path through nose 102 of setting tool 100, and interior of packer seal bore 212. Annular space 290 is in pressure and/or fluid communication with wellbore annular space 310 via a flow path between setting tool 100 and packer 200 indicated at point 312. This communication allows pressure equalization between the wellbore space 310 above and the wellbore space 300 below packer 200 so that differential pressure no longer exists across seals 106 of setting tool 100. In this embodiment, when release piston 112 shifts downward it is no longer positioned underneath and in contact with collet 126, thus allowing collet 126 and collet fingers 130 to spring inward or cam inward by and away from locking relationship with internal collet threads 206 of packer 200 by virtue of angled surfaces of collet teeth 130*a* as setting tool 100 is pulled or withdrawn from packer 200, so as to allow withdrawal of setting tool 100 from bore 210 of packer 200 at the appropriate time. Because the pressure differential no longer exists across seals 106, setting tool 100 may then be withdrawn from the bore of packer 200 by, for example, unscrewing or more typically straight pulling threaded collet 126 from internal collet threads 206 of packer 200, and retrieving setting tool 100 on tubing from bore 210 of packer 200. This may be done, for example, by retrieving a tubing string connected to threaded connection 164 of setting tool 100.

Either before or after setting tool 100 has been withdrawn from packer 200, tubing pressure (greater than that required to set packer 200, for example about 3200 psi) may be applied in order to shear screw 124 so that setting seat piston 122 drops to a second position adjacent nose 102 of setting tool 100, as shown in FIG. 6. In this position, setting seat piston 122 and ball 125 are now positioned adjacent and below unloading port 108 of setting tool 100 so that during retrieval of setting tool 100, fluid within the tubing may drain out unloading port 108 and thereby prevent the necessity of pulling a wet string.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed methods and apparatus may be utilized in various combinations and/or independently. Thus the invention is not limited to only those combinations shown herein, but rather may include other combinations.

What is claimed is:

1. A release tool for use with an isolation tool having an inner diameter, comprising:

a tool body having first and second ends, a longitudinal axis and an inner diameter and an outer diameter, said tool body outer diameter being complementary to said inner diameter of said isolation tool such that said tool body may be received within said isolation tool inner diameter to form a first annular space between said isolation tool inner diameter and said tool body outer diameter;

at least one equalizing port defined in said tool body between said first and second ends of said tool body, said equalizing port extending through said tool body from said tool body outer diameter to said tool body inner diameter;

a hydraulically actuated release piston having an inner diameter complimentary to said tool body outer diameter and being concentrically and slidably disposed about said tool body outer diameter, said release piston being slidable along said longitudinal axis of said tool body between first and second positions, said release piston having an outer diameter complimentary to said isolation tool inner diameter such that said tool body may be received within said isolation tool inner diameter;

a release piston first seal and a release piston second seal, said first and second release piston seals being disposed in sealing relationship between said release piston inner diameter and said tool body outer diameter, said first release piston seal being disposed toward said first end of said tool body and said second release piston seal being disposed toward said second end of said tool body, said first and second release piston seals being spaced apart to isolate said equalizing port from fluid communication with said first annular space when said release piston is in said first position and to allow fluid communication between said equalizing port and said first annular space when said release piston is in said second position.

2. The release tool of claim 1, wherein said tool body further comprises a third seal between said isolation tool inner diameter and said tool body outer diameter and being disposed between said release piston and said tool body second end, said third seal forming a seal between said isolation tool inner diameter and said tool body outer diameter to isolate said first annular space adjacent said first end of said tool body from said isolation tool inner diameter adjacent said second end of said tool body such that said release piston is shiftable between said first position and said second position in response to fluid pressure applied to said first annular space adjacent said first end of said tool body.

3. The release tool of claim 2, wherein said first and second release piston seals and said third seal isolate said first annular space adjacent said first end of said tool body from said isolation tool inner diameter adjacent said second end of said tool body when said release piston is in said first position; and wherein said first and second release piston seals allow fluid or pressure communication through said equalizing port between said first annular space adjacent said first end of said tool body and said isolation tool inner diameter adjacent said second end of said tool body when said release piston is in said second position.

4. The release tool of claim 1, wherein said tool body further comprises a setting seat piston having an outer diameter concentrically and slidably received within said inner diameter of said tool body to form a seal with said inner diameter of said tool body and being configured with an aperture and setting seat to receive a setting ball in sealing arrangement, said setting seat piston being operable between a first position adjacent said equalizing port and a second position between said equalizing point and said second end of said tool body.

5. The release tool of claim 4, wherein at least one unloading port is defined to extend through said tool body from said tool body outer diameter to said tool body inner diameter at a point located between said equalizing port and said second end of said tool body, and wherein said setting seat piston is operable between a first position adjacent said equalizing port and a second position adjacent or below said unloading port.

6. The release tool of claim 4, wherein said setting seat piston has a cylindrical body having an inner diameter; and wherein said setting seat piston further comprises a setting seat piston port defined to extend from said setting seat outer diameter to said setting seat inner diameter; and wherein said setting seat port is disposed adjacent said equalization port when said setting seat piston is in said first position to enable fluid communication between said equalizing port and said tool body inner diameter when said setting seat piston is in said first position.

7. The release tool of claim 4, wherein said isolation tool is set in response to a first fluid pressure applied to said inner diameter of said tool body from said first end of said tool body when a setting ball is sealably received in said setting seat of said setting seat piston; and wherein said setting seat piston is shiftable between said first position and said second position in response to a second fluid pressure applied to said inner diameter of said tool body from said first end of said tool body when a setting ball is received in said setting seat of said setting seat piston; and wherein said second fluid pressure is greater than said first fluid pressure.

8. The release tool of claim 1, further comprising a collet having collet fingers and concentrically disposed about said outer diameter of said tool body between said equalizing port and said first end of said tool body such that said release piston is disposed between said collet fingers and said tool body when said release piston is in said first position, and so that said release piston is disposed between said collet and said second end of said tool body when said release piston is in said second position.

9. The release tool of claim 8, wherein said release piston further comprises a release piston locking key movably disposed within said release piston, said release piston locking key being movable between a first position within said release piston and a second position extended outward from said release piston toward said isolation tool inner diameter; wherein said release piston locking key is contained in said first position by contact with said collet when said release piston is in said first position; wherein said tool further comprises a release piston spring disposed between said tool body outer diameter and said release piston locking key such that said release piston spring is contacted by and compressed by said release piston locking key when said release piston is positioned in said first position between said collet and said tool body, and such that said release piston locking spring contacts and forces said release piston locking key outward into said second position when said release piston is in said second position; and wherein said release piston locking key is positioned to contact said collet when in said second position to prevent movement of said release piston into said first position.

10. A method of releasing a release tool as defined in claim 1, said release tool being received in an isolation tool having an inner diameter, which method comprises:

moving said release piston from said first position to said second position to allow fluid communication between said equalizing port and said first annular space; and removing said tool body from said isolation tool.

11. The method of claim 10, wherein said tool body first end is adapted for connection to a retrieving medium, and wherein said step of removing comprises pulling said tool body from said inner diameter of said isolation tool with said retrieving medium.

12. The method of claim 10, wherein said tool body further comprises a third seal between said isolation tool inner diameter and said tool body outer diameter and being disposed between said release piston and said tool body second end, said third seal forming a seal between said isolation tool inner diameter and said setting tool body outer diameter to isolate said first annular space adjacent said first end of said tool body from said isolation tool inner diameter adjacent said second end of said tool body such that said release piston is shiftable between said first position and said second position in response to fluid pressure applied to said first annular space, and wherein said step of sliding further comprises applying sufficient fluid pressure to said first annular space to shift said release piston from said first to said second position.

13. A release mechanism for use with an isolation tool positioned within a wellbore and adapted to isolate a portion of the wellbore above the isolation tool from a portion of the wellbore below the isolation tool, comprising:

a tool body adapted to be received within said isolation tool;

a first port in the wall of said tool body enabling fluid communication between the portion of said wellbore above the isolation tool and the portion of the wellbore below said isolation tool; and a slide valve slideable in response to hydraulic annular pressure to move between a first seal position sealing said port and a second open position exposing said first port.

14. The release mechanism of claim 13 wherein said slide valve comprises an annular slide valve fitted between the tool body and the isolation tool.

15. The release mechanism of claim 13, wherein the tool body is adapted at its upper end to be connected to a retrieving medium; wherein an annular portion of the wellbore is defined between said retrieving medium and said wellbore; and wherein said first port enables fluid communication between the annular portion of the wellbore above the isolation tool and the portion of the wellbore below the isolation tool.

16. The release mechanism of claim 13, wherein said slide valve is fitted around the tool body and movable relative to the tool body in response to a pressure differential between said annular portion of the wellbore and the portion of the wellbore below the isolation tool to move from said first sealing position to said second open position exposing the first port to fluid communication with said annular portion of the wellbore.

17. The release mechanism of claim 15, wherein the slide valve is slideable from said first seal position to said second open position in response to a preselected differential pressure between the annular portion of the wellbore above the isolation tool and the portion of the wellbore below the isolation tool.

18. The release mechanism of claim 13, wherein said tool body includes a setting mechanism operable to set the isolation tool within the wellbore.

19. The release mechanism of claim 18, wherein said tool body has upper and lower ends and is adapted at its upper end to be lowered within a wellbore on a conduit string and is further adapted to releasably engage and set the isolation tool against the wall of the wellbore, said tool body defining a central longitudinal bore in fluid communication with the conduit string and said first port extending through the wall of the tool body to enable fluid communication between the annular space between the conduit string and the wall of the wellbore and the portion of the wellbore below the set isolation tool.

20. The release mechanism of claim 13, wherein the isolation tool comprises a packer.

21. The release mechanism of claim 13, wherein the isolation tool comprises a bridge plug.

22. The release mechanism of claim 19, further comprising a valve seat positioned in said central longitudinal bore in a first position and adapted to seat a valve operable to block fluid flow down through the central longitudinal bore.

23. The release mechanism of claim 22, wherein the tool body defines a second port extending laterally from the central longitudinal bore through the wall of the tool body and being positioned between said first position and the lower end of the tool body.

24. The release mechanism of claim 23, wherein the valve seat is movable between said first position and a second position exposing said second port to said central longitudinal bore.

25. The release mechanism of claim 24, wherein the valve seat is movable when seating a valve toward said second position in response to fluid pressure within the central longitudinal bore above the valve seat.

26. The release mechanism of claim 22, wherein the valve seat is configured to receive a generally spherical valve.

27. A method of removing a release mechanism as defined in claim 13 from an isolation tool positioned in a wellbore to isolate a portion of the wellbore above the isolation tool from a portion of the wellbore below the isolation tool, which method comprises:

moving the slide valve from its first sealing position to its second open position to thereby reduce any pressure differential between the two portions of the well; and thereafter removing the release mechanism from the isolation tool.

28. The method of claim 27, wherein the tool body is adapted at its upper end to be connected to a retrieval medium; wherein an annular portion of the wellbore is defined between said retrieval medium and said wellbore; wherein said first port enables fluid communication between the annular portion of the wellbore above the isolation tool and the portion of the wellbore below the isolation tool; wherein said slide valve is fitted around the tool body and movable relative to the tool body in response to a pressure differential between said annular portion of the wellbore and the portion of the wellbore below the isolation tool to move from said first sealing position to said second open position exposing the first port to fluid communication with said annular portion of the wellbore; and wherein the step of moving comprises:

applying sufficient pressure within the annular space to move the slide valve from the upper position to the lower position and reduce any said pressure differential.

* * * * *